US005078069A

United States Patent [19]

August et al.

[11] Patent Number: 5,078,069

[45] Date of Patent: Jan. 7, 1992

[54] WARHEAD

[75] Inventors: Henry August, Chatsworth; Richard D. Joos, Glendora, both of Calif.

[73] Assignee: Hughes Aircraft Company, Los Angeles, Calif.

[21] Appl. No.: 500,639

[22] Filed: Mar. 27, 1990

[51] Int. Cl.[5] ..... F42B 12/16; F42B 19/00

[52] U.S. Cl. ..... 114/20.1; 102/399; 102/476

[58] Field of Search ..... 114/20.1; 102/399, 306, 102/307, 309, 476, 475

[56] References Cited

U.S. PATENT DOCUMENTS

| | | | |
|---|---|---|---|
| 3,109,373 | 11/1963 | Saffer | 102/399 |
| 3,190.372 | 6/1965 | Johnson | 102/306 |
| 3,216,320 | 11/1965 | Thomas et al. | 102/306 |
| 4,063,512 | 12/1977 | Davis | 102/476 |
| 4,188,884 | 2/1980 | White et al. | 114/20.1 |
| 4,574,702 | 3/1986 | Brandt | 102/476 |
| 4,714,022 | 12/1987 | Chaumeau et al. | 102/476 |
| 4,967,666 | 11/1990 | Kellner et al. | 102/476 |

FOREIGN PATENT DOCUMENTS

| | | | |
|---|---|---|---|
| 0201433 | 12/1986 | European Pat. Off. | 102/476 |
| 3601051 | 6/1987 | Fed. Rep. of Germany | 102/476 |
| 3341649 | 9/1989 | Fed. Rep. of Germany | 102/476 |

*Primary Examiner*—David H. Brown

*Attorney, Agent, or Firm*—R. M. Heald; C. D. Brown; W. K. Denson-Low

[57] ABSTRACT

A warhead, used in a torpedo, includes an expolsive device that is detonatable within a breached water-tight compartment such that damage to the target is enhanced by the presence of the confined incompressible fluid therewithin.

14 Claims, 2 Drawing Sheets

WARHEAD

BACKGROUND OF INVENTION

The present invention generally relates to a warhead and, in particular, relates to a warhead having means for delivering an explosive device into a compartment.

Conventional warheads for use against either partially to totally submerged targets usually carry a large amount of explosive material to ensure the disabling or destroying of the target. Hence, such warheads, when designed for use against large targets, are usually quite heavy and, as a consequence, require substantial motors for delivery to the target. This results in such a weapon having a relatively easily detected sonic signature that may allow a target to readily detect the approach of the weapon and take evasive action and avoid substantial damage.

Further, in most instances, a considerable amount of damage must be inflicted within the hull, i.e., internally, in order to ensure the complete disabling or destruction of the target vessel. One reason for this is, in addition to the strength and thickness of the hull material, the internal compartments of such targets are usually separated by water-tight walls, or bulkheads. Hence, conventionally, the warhead used against such a target must carry sufficient explosive material to ensure not only the breaching of the hull but also the breaching of one or more of the bulkheads.

More recently, various hull designs have been developed that are capable of sustaining considerable warhead damage without the breaching of the bulkheads adjoining the compartment directly hit by the warhead. Thus, more than a single direct hit may be required to disable or destroy a target using conventional warheads.

Consequently, a warhead for use against a partially or totally submerged target, such as a submarine, that will inflict sufficient damage to disable or destroy such a target with a single hit is clearly needed.

SUMMARY OF THE INVENTION

Accordingly, it is one object of the present invention to provide a warhead that substantially completely overcomes the above-discussed drawbacks associated with conventional warheads.

This object is accomplished, at least in part, by a warhead having a housing including therein a means for breaching a water-tight chamber, an explosive device, means for delivering the explosive device into the chamber and means for detonating the explosive device within the chamber subsequent to the explosive device being delivered into the chamber.

Other objects and advantages of the present invention will become apparent to those skilled in the art from the following detailed description read in conjunction with the appended claims and the drawings attached hereto.

BRIEF DESCRIPTION OF THE DRAWINGS

The drawings, not drawn to scale, include.

DETAILED DESCRIPTION OF THE INVENTION

Figure 1:
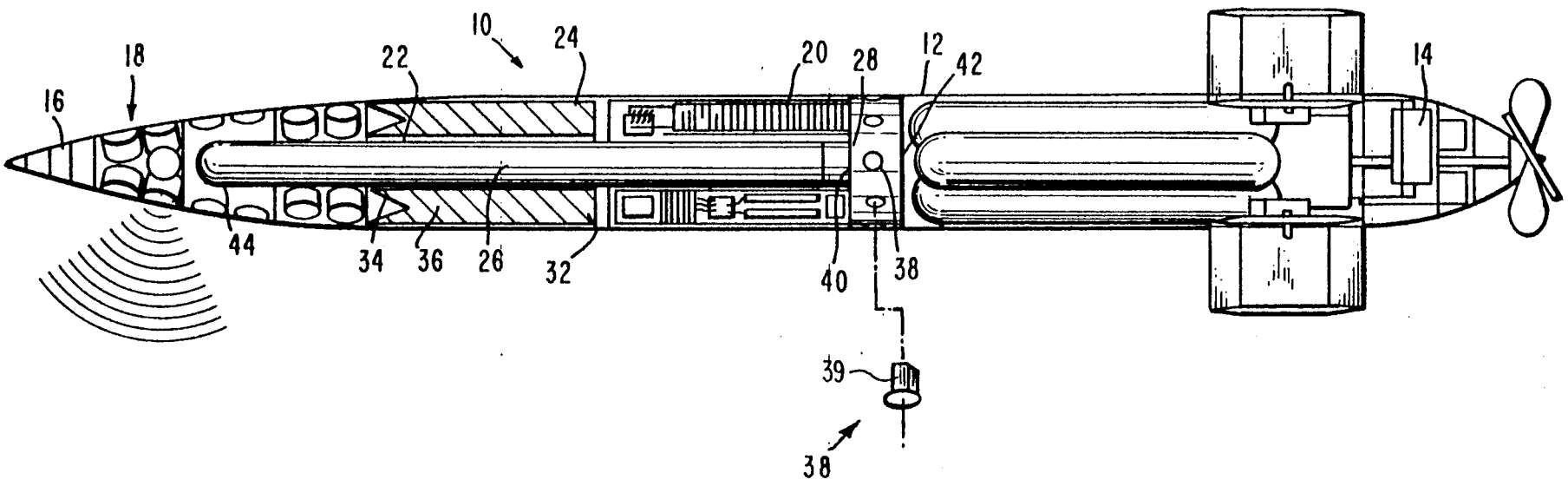
FIG. 1—a cross-sectional view of a torpedo having a warhead embodying the principles of the present invention.

A torpedo, generally indicated at 10 in FIG. 1, adapted for use with the present invention includes a housing 12 having therein means 14 for propelling the torpedo 10 to a target, now shown in FIG. 1. Typically, the torpedo 10 also includes a contact fuze 16 proximate the forward end 18 thereof, a guidance and control section 20 and a warhead 22. For reasons more fully discussed below, the guidance and control section 20 of the torpedo 10 is fabricated about an annular opening.

The warhead 22, embodying the principles of the present invention, includes means 24, within the housing 12, for breaching a water-tight submerged compartment, an explosive device 26, means 28 for delivering the explosive device 26 into the compartment and apparatus 30 for detonating the explosive device 26 inside the compartment subsequent to the explosive device 26 being delivered thereinto.

Figure 2:
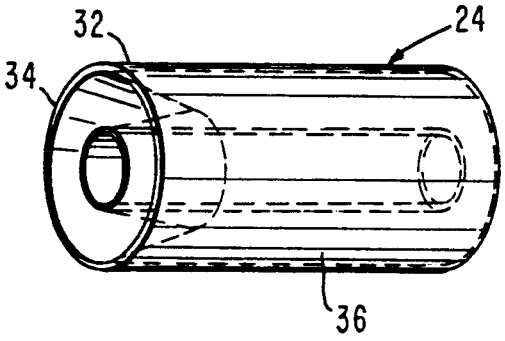
FIG. 2—a perspective view of an annular linear shaped charge particularly useful with the warhead of the present invention.
Figure 3:
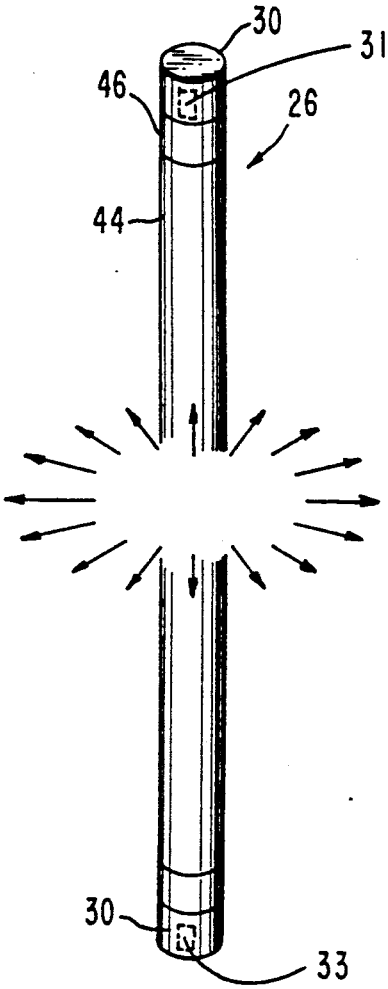
FIG. 3—a cross-sectional view of an explosive device particularly useful with a warhead embodying the principles to the present invention.

In one embodiment, the means 24 for breaching the water-tight submerged compartment includes an annular linear shaped charge 32. An exemplary annular linear shaped charge 32 is shown in FIG. 2 having a metal housing 34, or lining, encasing a high explosive material 36, such as, for example, PBXW-113. The shape of the metal housing 34 ensures that the force of the explosion of the explosive material 36 is directed through the forward end 18 of the torpedo 10. It should be understood that explosive configurations other than the described annular linear shaped charge 32, such as, for example, a boosted kinetic penetrator, can also be used to breach the water-tight compartment.

Further, in this embodiment, the means 28 for delivering the explosive device 26 into the compartment includes a plurality of explosive port covers 38 disposed about the periphery of the housing 12 aft of the explosive device 26. A typical explosive port cover 38 is shown in FIG. 1*a* to include a conventional explosive charge 39. The explosive port covers 38 seal a cavity 40 that is defined within the housing 12 aft of the explosive device 26. The cavity 40 is further defined by a wall 42 disposed forward of the means 14 for propulsion. At shallow depths the means 28 can include a pyrotechnic device to deliver the explosive device 26 into the compartment.

In one embodiment, the explosive device 26 includes a casing 44 and the means 30 for detonating the explosive device 26. Alternatively, to better ensure a radially directed explosion, i.e., an explosion within the compartment that is directed toward the intercompartment bulkheads, in one embodiment, the explosive device 26 includes a floatation device 46 disposed within the casing proximate one end thereof. Preferably, the casing 44 is an elongated hollow cylinder containing high explosive material. The sue of a floatation device 46 ensure that the explosive device 26 is oriented within the flooded compartment with the elongated sides of the casing 44 substantially lateral with the internal bulkheads of the compartment. Hence, the side moving hydroshock of the blast will be maximized. Further, in one preferred embodiment, the explosive device 26 is provided with an apparatus 30 for detonating the device 26 at each end of the elongated cylinder which detonators are initiated simultaneously. To accommodate such an elongated cylinder the guidance and control section 20 is preferably disposed to provide an annular opening.

The apparatus 30 for detonating the explosive device 26 within the compartment is disposed within the casing 44 and, in one preferred embodiment, includes a timing mechanism 31. Alternatively, the apparatus 30 can include a pressure sensitive mechanism 33 that detonates the high explosive material within the casing 44 only upon a preselected pressure being developed against the external surface of the apparatus 30.

In operation, when the torpedo 10 strikes a target, the contact fuze 16 explodes thereby detonating the annular linear shaped charge 32 and, simultaneously, sympathetically exploding conventional charges 39 within explosive port covers 38, causing covers 38 to separate from housing 12 and uncover cavity 40. The explosion of the annular linear shaped charge 32 results in the breaching of the hull. The sympathetic explosion of the explosive port covers 38 results in the flooding of the cavity 40 between the wall 42 of the propulsion means 14 and the explosive device 26. As a result, when the cavity 40 is filled via the now open ports, the aft end of the explosive device 26 is subject to the full pressure of the surrounding environment causing it to be ejected from the housing 12 into the compartment.

In one typical embodiment, the annular linear shaped charge 32 forms a flooding hole in the hull of the target that allows delivery of the explosive device 26 into the compartment of the target internal to the hull. Typically, a ten inch diameter annular linear shaped charge 32 is capable of propagating through the forward end 18 of the torpedo 10 as well as the layered hull of the target. Such a charge would typically result in about at seven inch hole in the hull through which the explosive device 26 can be delivered. Alternatively, if desired, a larger diameter hull opening could be provided by means of a boosted kinetic penetrator.

The explosive device 26 is then caused to explode, in one embodiment, after a preselected time delay. The length of time selected is determined, in general, so that the explosive device 26 is detonated after the compartment is substantially filled with water. As a consequence, the explosive device 26 is detonated within the compartment that is substantially filled with an incompressible fluid, i.e., sea water, and therefore the blast effect is significantly increased and generates hydraulic shock overpressure impulse loading upon the inner compartment walls. Thus, the inner walls, or bulkheads are ruptured and result in the flooding of at least three inner compartments of the target. The increase in the blast, or shock effect, is dependent upon the amount of water in the compartment at the time of detonation of the explosive device 26. Alternatively, a pressure detonator can be used instead of a time delayed fuze to ensure that the compartment is substantially completely filled before detonation of the explosive device 26.

Subsequent to the reflected shock wave overpressures, multiple wall-to-wall reflections will then ensure until the shock energy is dissipated as heat. Further, hydrostatic overpressures, due to expansion and contraction of the primary gas bubble formed by the blast, will act to damage the internal structure of the target. Overpressure levels are enhanced by the confined incompressible fluid, i.e. sea water, within the compartment of the target.

In one specific embodiment, the annular linear shaped charge 32 is arranged in a ten inch diameter having an annular opening of about seven inches therethrough. The explosive material 36 can be about 30 pounds of high explosive or a similar material, such as, for example, PBXW-113.

The ports are about 1–2 inches in diameter and disposed, in one embodiment, substantially uniformly about the periphery of the housing 12 of torpedo 10. Preferably, the cavity 40 within the torpedo 10 has a volume of about 4–8 cubic inches.

In such an embodiment, the explosive device 26 can be about forty inches long and about four inches in diameter. Preferably, the explosive device 26 is fabricated with a comparatively thin stainless steel wall and comparatively thick stainless steel endcaps. Further, the explosive device 26 can be loaded with about 30 pounds of high explosive material, such as, for example PBXW-113.

It will be understood that other materials an dimensions can be used depending on the particular mission intended.

Although the present invention has been discussed with respect to embodiments, other configurations and arrangements can also be made by those skilled in the art which do not depart from the spirit and scope of the present invention. Hence, the present invention is deemed limited only by the appended claims and the reasonable interpretation thereof.

What is claimed is:

1. A warhead comprises:

means for penetrating a submerged portion of a hull such that fluid communication through the hull to a compartment therewithin is established;

means for delivering an explosive device into said compartment;

said delivery means comprising a cavity defined behind said explosive device and means for opening said cavity to allow fluid under pressure to fill said cavity such that said explosive device is ejected into said compartment; and means for detonating said explosive device within said compartment subsequent to the substantial filling of said compartment with fluid.

2. The warhead as claimed in claim 1 wherein said means for penetrating a hull includes:

an annular linear shaped charge.

3. The warhead as claimed in claim 1 wherein said explosive device includes:

a casing, said casing having a high explosive material contained therein.

4. The warhead as claimed in claim 1 wherein said explosive device includes:

an elongated casing, said casing having a high explosive material contained therein; and a flotation device, said flotation device being disposed proximate one end of said elongated casing such that upon detonation the maximum blast effect is directed against the internal bulkheads of the compartment.

5. The warhead as claimed in claim 1 wherein said means for detonating includes:

a time delay fuze, and time delay fuze being disposed within a casing enclosing said explosive device.

6. The warhead as claimed in claim 1 wherein said means for detonating includes:

a pressure sensitive detonator, said pressure sensitive detonator being disposed within a casing enclosing said explosive device.

7. The warhead as claimed in claim 1 wherein said cavity opening means includes:

a plurality of ports, said ports having covers disposed between said cavity and said fluid under pressure; and means for removing said covers.

8. The warhead as claimed in claim 7 wherein said cover removing means includes an explosive material.

9. The warhead as claimed in claim 1 wherein said explosive device is an elongated cylinder and includes a means for detonating said explosive device at each and thereof.

10. The warhead as claimed in claim 9 wherein said explosive device includes:

a flotation device, said flotation device being disposed proximate one end of said elongated cylinder such that upon detonation the maximum blast effect is directed against the internal bulkheads of the compartment.

11. A torpedo comprises:

a housing, means, within said housing, for propelling said torpedo toward a target;

a guidance and control section, said guidance and control section being annularly disposed within said housing;

a contact fuze, said contract fuze being disposed proximate the forward end of said torpedo;

means for penetrating a submerged portion of a hull such that fluid communication through said hull to a compartment therewithin is established;

means for delivering an explosive device into said penetrated compartment; and means for detonating said explosive device within said compartment subsequent to the substantial filling of said compartment.

12. The torpedo as claimed in claim 11 wherein said means for penetrating said hull includes an annular linear shaped charge.

13. The torpedo as claim in claim 11 wherein said delivery means includes;

a cavity, said cavity being defined between said explosive device and said propulsion means; and means for opening said cavity to allow fluid under pressure to fill cavity such that said explosive device is ejected through the forward end of said torpedo.

14. The torpedo as claimed in claim 13 wherein said cavity opening means includes;

a plurality of ports said ports having covers disposed between said cavity and said fluid under pressure; and means for removing said covers, said cover removing means including an explosive material.

* * * * *

UNITED STATES PATENT AND TRADEMARK OFFICE

CERTIFICATE OF CORRECTION

PATENT NO. : 5,078,069

DATED : January 7, 1992

INVENTOR(S) : Henry August, Richard D. Joos

It is certified that error appears in the above-identified patent and that said Letters Patent is hereby corrected as shown below:

Abstract, first line "expolsive" should read --explosive--.

In the Claims

Column 6, line 12, instead of the word "claim" insert --claimed--

Column 6, line 17, after the word "fill" insert --said--

Column 6, line 22, after the word "ports" insert -- , --

Signed and Sealed this

Eleventh Day of May, 1993

*Attest:*

Michael K. Kirk

MICHAEL K. KIRK

*Attesting Officer*

*Acting Commissioner of Patents and Trademarks*